United States Patent [19]

Ninomiya

[11] 4,442,815

[45] Apr. 17, 1984

[54] OPTIMUM AIR-FUEL RATIO CONTROL FOR INTERNAL COMBUSTION ENGINE

[75] Inventor: Masakazu Ninomiya, Kariya, Japan

[73] Assignee: Nippondenso Co., Ltd., Kariya, Japan

[21] Appl. No.: 391,687

[22] Filed: Jun. 24, 1982

[30] Foreign Application Priority Data

Jun. 26, 1981 [JP] Japan ..... 56-99305

[51] Int. Cl.[3] ..... F02D 37/00

[52] U.S. Cl. ..... 123/436; 123/480; 123/585; 364/431.05

[58] Field of Search ..... 123/585–589, 123/488, 440, 480; 364/431.05

[56] References Cited

U.S. PATENT DOCUMENTS 4,026,251 5/1977 Schweitzer et al. ..... 123/436

4,064,846 12/1977 Latsch et al. ..... 123/436

4,232,643 11/1980 Leshner et al. ..... 123/436

4,368,707 1/1983 Leshner et al. ..... 123/585

*Primary Examiner*—William A. Cuchlinski, Jr.

*Attorney, Agent, or Firm*—Cushman, Darby & Cushman

[57] ABSTRACT

In an air-fuel ratio control system the air-fuel ratio is changed by changing the auxiliary air supply amount in a bypass path with respect to a main path for supplying air to the engine in the vicinity of an optimum air-fuel ratio. Signals representing the operating conditions such as rotational speed of the engine operated at the resulting different air-fuel ratios are detected at a plurality of operating points. The signals thus detected are compared and the fuel injection amount is regulated thereby to correct the air-fuel ratio so that the fuel consumption rate may become optimum.

8 Claims, 7 Drawing Figures

| P \ N | --- | --- | r-2 | r-1 | r | r+1 | r+2 | --- | --- |
|---|---|---|---|---|---|---|---|---|---|
| ⋮ | | | | | | | | | |
| ⋮ | | | | | | | | | |
| p-1 | | | T(p-1,r-2) | T(p-1,r-1) | T(p-1,r) | T(p-1,r+1) | T(p-1,r+2) | | |
| p | | | T(p,r-2) | T(p,r-1) | T(p,r) | T(p,r+1) | T(p,r+2) | | |
| p+1 | | | T(p+1,r-2) | T(p+1,r-1) | T(p+1,r) | T(p+1,r+1) | T(p+1,r+2) | | |
| ⋮ | | | | | | | | | |
| ⋮ | | | | | | | | | |

OPTIMUM AIR-FUEL RATIO CONTROL FOR INTERNAL COMBUSTION ENGINE

BACKGROUND OF THE INVENTION

The present invention relates to a method and apparatus for controlling the air-fuel ratio of internal combustion engines, or more in particular to a method and apparatus for air-fuel ratio control in which the air-fuel ratio is controlled to an optimum value associated with the optimum fuel consumption rate by feedback control.

Generally, the air-fuel ratio is set to a stoichiometric ratio or a leaner value than that with emphasis placed on the fuel consumption rate under general running conditions, that is, to about 13 or a value with the highest output while the acceleration pedal is depressed to the full such as when ascending a slope, and to a value considering the stability when idling.

In the conventional air-fuel control under general running conditions, the carburetor is subjected to open-loop control and some loss of the fuel consumption rate is caused by variations between internal combustion engines, the secular variation of the internal combustion engine involved and variations between carburetors. An electronically-controlled fuel injection system for measuring the intake air amount of the internal combustion engine with an air flow sensor or the like, computing the required fuel amount with a computer or the like and injecting the fuel from fuel injectors according to the computation practically uses a closed loop control for deciding the direction of the stoichiometric ratio (about 15) from the oxygen sensor provided in the exhaust pipe and for correcting the fuel amount. Also, a closed loop control for the carburetor in which the air amount of the air bleed is corrected by determining the direction of the stoichiometric ratio by the oxygen sensor finds partial applications. These closed loop controls are capable of correcting the variations of the air-fuel ratio, but result in the loss of fuel consumption rate since the stoichiometric ratio is not a value associated with the best fuel consumption rate.

A conventional method has been suggested for controlling the fuel consumption rate without the above-mentioned loss. In such a control method, the air bypassing an air amount sensor and the throttle valve is made to dither at regular intervals of time between rich and lean sides of the air-fuel ratio, the direction of the air-fuel ratio associated with an improved fuel consumption rate is determined, and the air-fuel ratio is corrected by an auxiliary air valve bypassing the air amount sensor. In this method, the engine is run once at each of the relatively rich and lean levels of the air-fuel ratio, so that the engine speed Ner for the rich air-fuel ratio is compared with the engine speed Nel for the lean air-fuel ratio, and if Ner is larger than Nel, the bypass air amount is reduced, while if Ner is smaller than Nel, the bypass air amount is increased.

In determining the change of output from the engine speed which is changed by various factors, however, the above-mentioned conventional method of control is incapable of determining whether the engine speed is changed by the change of the air-fuel ratio or operation of the acceleration pedal or by ascending or descending a slope, with the result that the control may be effected in the direction reverse to the improvement of fuel consumption rate, thus deteriorating the fuel consumption rate. Further, the air passing through the air amount sensor may change and also may not change in cases when the air is applied through a bypass of the air amount sensor and the throttle valve and when the air is not applied therethrough, and it could not be assumed that a fuel flow rate is always constant. As a result, it may occur that the best fuel consumption rate is not achieved but a loss is caused.

SUMMARY OF THE INVENTION

In view of the above-mentioned disadvantage of the conventional systems, an object of the present invention is to provide a method and apparatus for controlling the air-fuel ratio in which while controlling the air-fuel ratio by detecting the change of engine speed under operating conditions associated with at least two different air-fuel ratios, the internal combustion engine is always controlled to be operated with the optimum fuel consumption rate.

According to the present invention, there is provided a method and apparatus for controlling the air-fuel ratio, in which the air supply amount in a bypass of an air supply path is changed between at least two different air-fuel ratios near an optimum air-fuel ratio, the engine is operated for a predetermined length of time alternately between the two air-fuel ratios in such a manner that the fuel flow rate for the leaner of the two air-fuel ratios is the same as that for the richer one thereof, signals representing the rotational speed of the internal combustion engine, torque or other operating conditions related thereto are detected at a plurality of operating points when the engine is operated at these different air-fuel ratios, the signals thus detected are compared at the operating points thereby to decide whether the optimum air-fuel ratio is rich or lean as compared with the air-fuel ratio associated with the optimum fuel consumption rate, and the amount of fuel is regulated thereby to correct the air-fuel ratio on the basis of the result of the decision.

According to the present invention, in controlling the air-fuel ratio of internal combustion engines by detecting the change of engine speed under the operating conditions for at least two different air-fuel ratios, through correction of the change of the fuel flow rate between the lean step with an electromagnetic valve open and the rich step with the electromagnetic valve closed the internal combustion engine can be controlled to operate always at the optimum fuel consumption rate.

DESCRIPTION OF THE PREFERRED EMBODIMENTS

Figure 1:
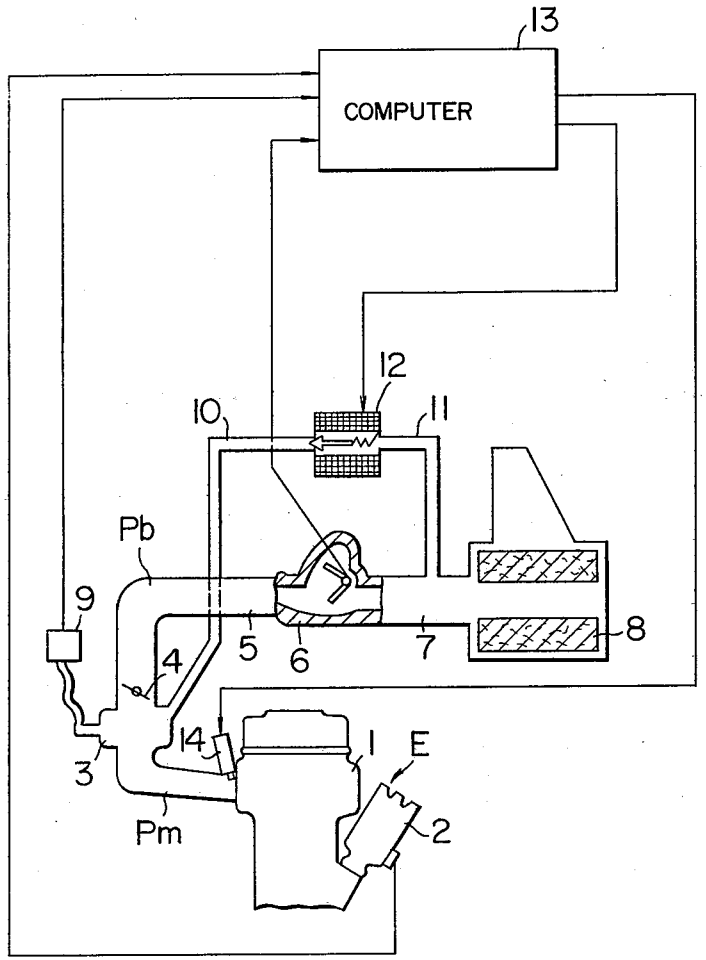
FIG. 1 is a diagram showing an apparatus for controlling the air fuel ratio of an internal combustion engine according to an embodiment of the present invention.

An embodiment according to the present invention is shown in FIG. 1. The air-fuel control system shown in FIG. 1 comprises an internal combustion engine 1, a rotational angle sensor 2 constructed integrally with a distributor, an intake pipe 3 placed downstream of the throttle valve 4, the throttle valve 4 interlocked operatively with the acceleration pedal, and an air flow sensor 6. The air flow sensor 6 is for detecting the air flow rate in such a manner that the opening of a baffle plate in the air path is changed with a flow rate of air and the output voltage generated by the sensor changes with the opening of the baffle plate. The air-fuel ratio control system shown in FIG. 1 also comprises an air-introducing downstream pipe 5 connecting the air flow sensor 6 and the throttle valve 4, an air cleaner 8, an air introducing upstream pipe 7 connecting the air cleaner 8 and the air flow sensor 6, a pressure sensor 9 for detecting the pressure of the intake pipe, a bypass air electromagnetic valve 12 installed to bypass the air amount sensor 6 and the throttle valve 4, a bypass downstream introducing pipe 10 for connecting the bypass air electromagnetic valve 12 and the intake pipe 3, a bypass upstream introducing pipe 11 connecting the bypass air electromagnetic valve 12 and the air introducing upstream pipe 7, and a computer 13. In response to the signals from the air amount sensor 6 and the rotational angle sensor 2, the computing circuit 13 computes the injection amount of the injection valve 14 for time being as a pulse duration and generates an output signal to be supplied to the electromagnetic injection valve 14 for intermittently injecting the fuel maintained at a predetermined pressure according to the pulse duration.

The computer 13 will be described in detail with reference to FIG. 2. Numeral 100 designates a microprocessor (CPU) for computing the pulse duration for the injector, and numeral 101 designates an engine speed counter unit for measuring the engine speed in response to the signal from the engine rotational angle sensor 2. The engine speed counter unit 101 applies an interruption command signal to the interruption control section 102 in synchronism with the engine rotations. In response to this signal, the interruption control section 102 applies an interruption signal to the microprocessor 100 through a common bus 150. Numeral 103 designates a digital input port for transmitting to the microprocessor 100 a digital signal such as a starter signal from the starter switch 16 for turning on and off the operation of the starter (not shown). Numeral 104 designates an analog input port including an analog multiplexer and an A/D converter and has the function to cause the signals from the air-flow sensor 6, the pressure sensor 9 and the cooling water temperature sensor 15 to be subjected to A/D conversion and read into the microprocessor 100. The output data of the units 101, 102, 103 and 104 are applied to the microprocessor 100 through the common bus 150. Numeral 105 designates a power supply circuit for supplying power to the RAM 107 described later. Numeral 17 designates a battery and numeral 18 a key switch. The power supply circuit 105 is connected directly to the battery 17 but not through the key switch 18. The RAM 107 is thus impressed with the power supply all the time regardless of the position of key switch 18. Numeral 106 also designates a power supply circuit, which is connected through the key switch 18 to the battery 17. The power supply circuit 106 is for supplying power to the parts other than RAM 107. The RAM 107 is a temporary memory unit used temporarily while the computer 13 is programmed for operation and provides a nonvolatile memory supplied with power always regardless of the key switch 18 so that the data stored therein is not erased even when the engine operation is stopped by turning off of the key switch 18. The learning map correction amount ΔT is also stored in this RAM 107. Numeral 108 designates a read-only memory (ROM) for storing various constants and a program. Numeral 109 designates a fuel injection time control counter including a register and provides a down counter for converting a digital signal representing the open time of the fuel injector 14, namely, the fuel injection amount computed at the microprocessor (CPU) 100 into a pulse signal of time duration representing the actual open time of the fuel injector 14. Numeral 110 designates a power amplifier section for driving the fuel injector 14. Numeral 111 designates a timer for measuring the elapsed time and applying it to the CPU 100.

The rotational speed counter unit 101 is for measuring the engine rotational speed by measuring the time of each engine rotation and supplies an interruption command signal to the interruption control section 102 at the end of the measurement. In response to this signal, the interruption control section 102 generates an interruption signal and causes the microprocessor 100 to execute the interruption processing routine for computing the fuel injection amount.

Figure 3:
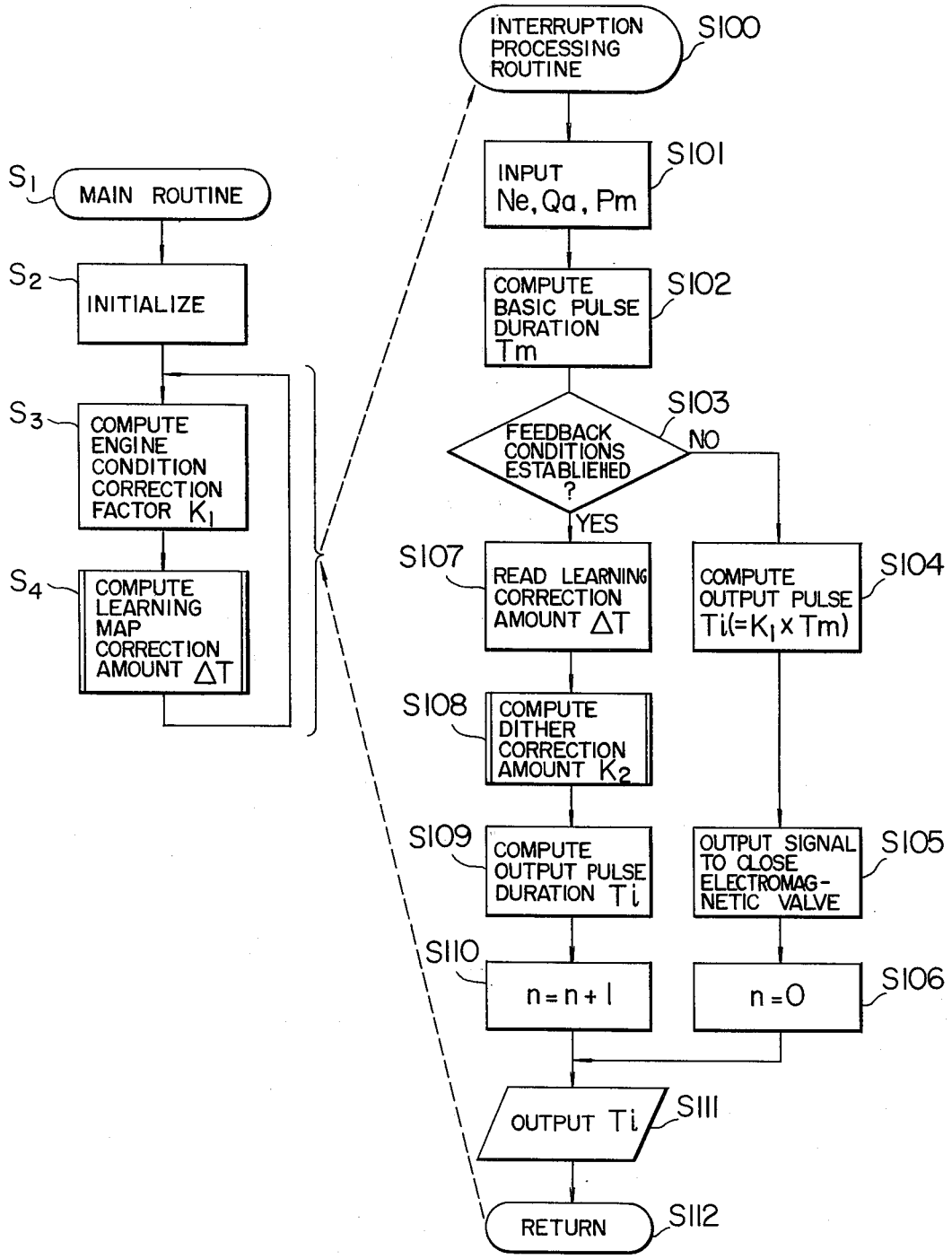
FIG. 3 is a flowchart showing the processing operation of the computing circuit.

The processes of the processing operation at the computer 13 is shown in the flowchart of FIG. 3. When the key switch 18 and the starter switch 16 are turned on thereby to start the engine 1, the process is started from the step S1. At step S2, the condition of the electromagnetic valve and the counter of injection number n are initialized, i.e. the electromagnetic valve is closed and the injection number n is reduced to zero. The step S3 computes the engine condition correction factor K1 in response to the starter switch 16 and the engine cooling water temperature sensor 15 and stores the result of computation into the RAM 107. At step S4, the learning map correction amount ΔT described later is computed and the result is stored in RAM 107.

Figure 4:
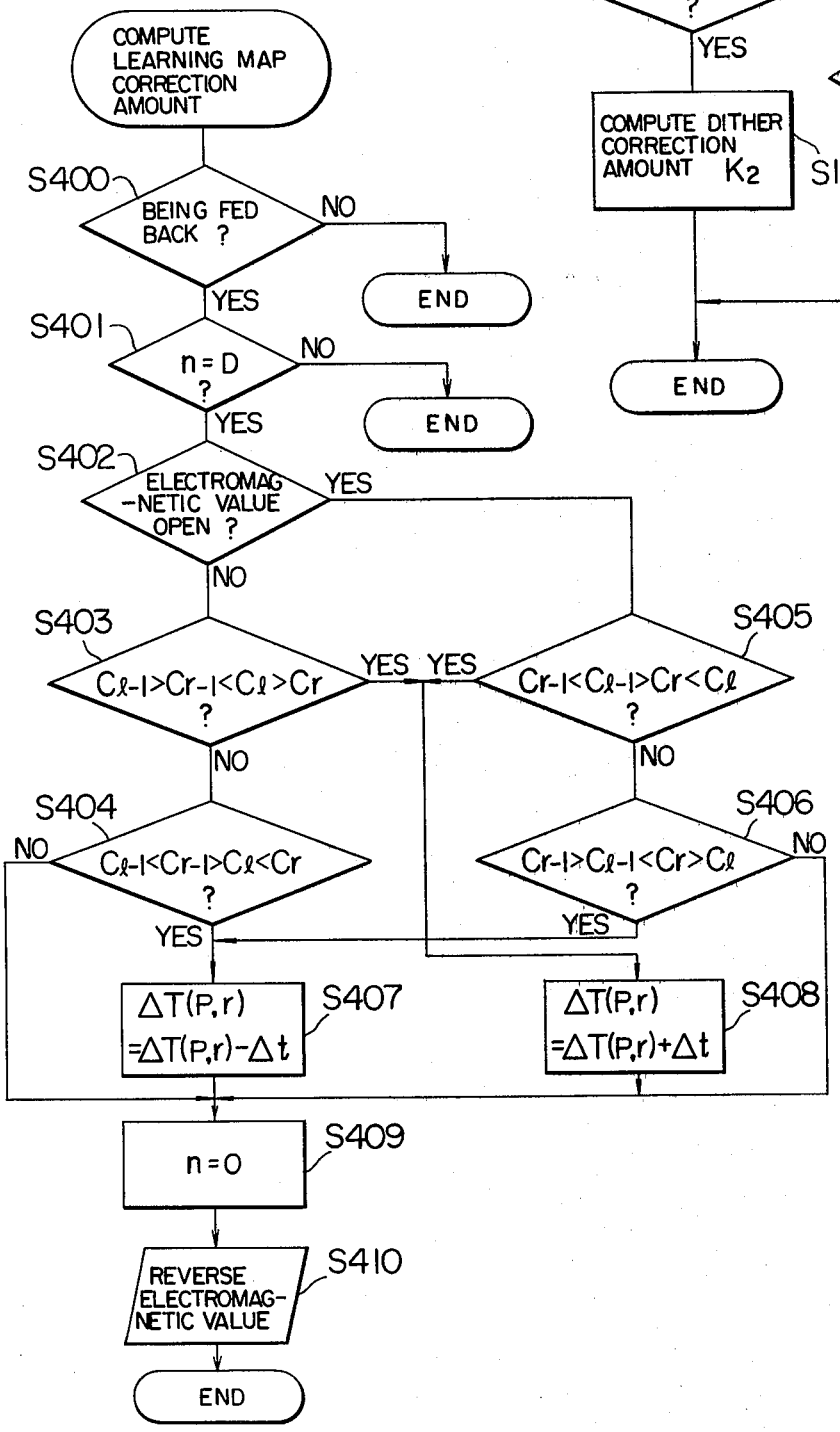
FIG. 4 is a detailed flowchart of the learning map correction amount computing step shown in FIG. 3.

FIG. 4 shows detailed flowchart of the step S4 for computing the learning map correction amount ΔT. At step S400, it is decided whether or not the feedback is established for controlling the engine to the best fuel consumption rate, that is, whether or not the cooling water temperature is higher than 70° C. and the starter switch is turned off. If the feedback condition is not established, the process of step S4 is completed and the process is passed to step S3. If the feedback condition is established, on the other hand, the process proceeds to step S401 for deciding whether or not the injection count n has reached the set number D. Until the set number D is reached, the correction amount ΔT is not computed but the process of step S4 is completed and passed to step S402.

Figure 2:
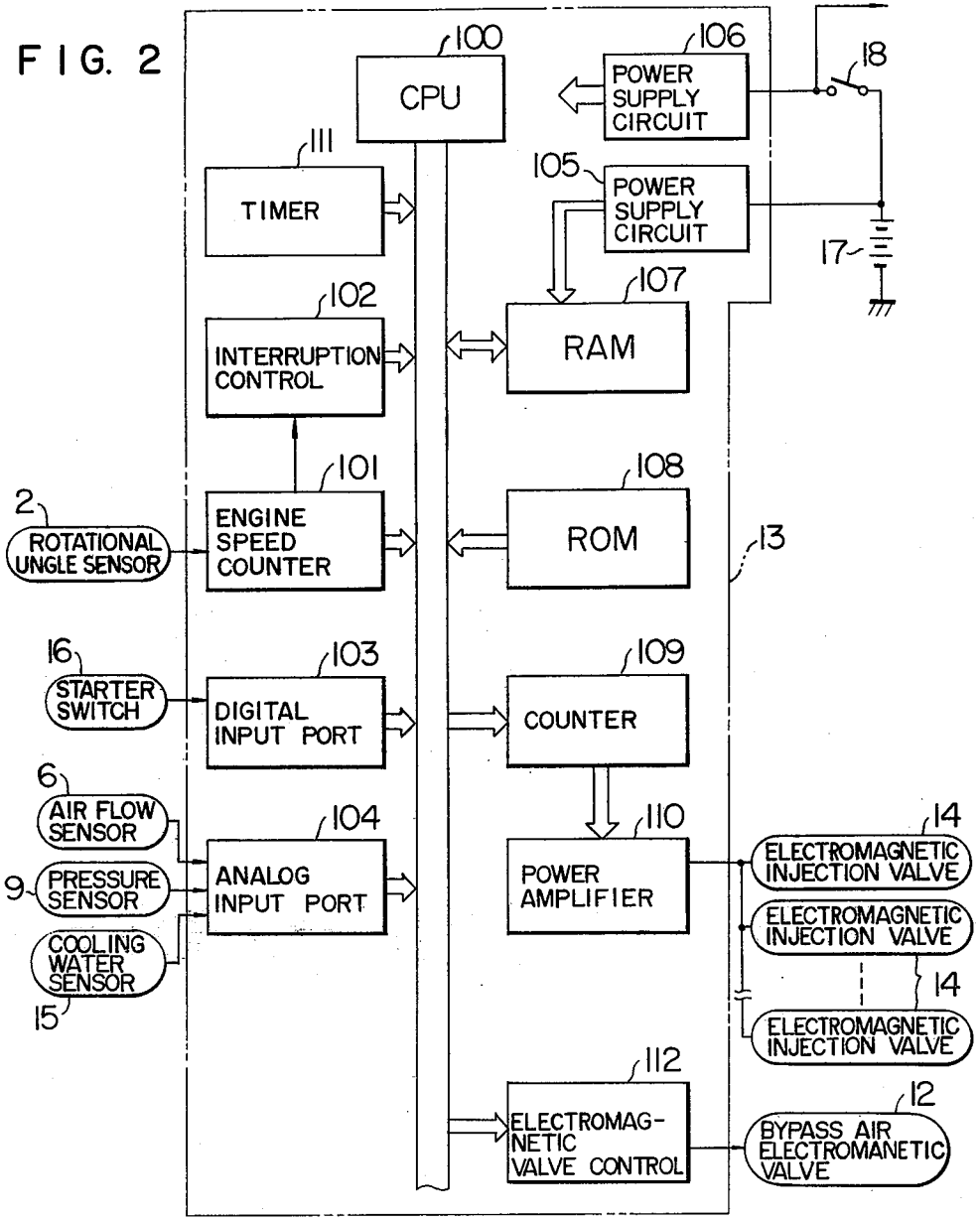
FIG. 2 is a block diagram showing a computing circuit of FIG. 1.

Referring to FIGS. 2 and 3, normally, the processing operation of the main routine including steps S3 to S4 are repeatedly executed according to the control program. In response to an injection interruption signal from the interruption control 102, the microprocessor 100 immediately suspends the processing operation of the main routine and is transferred to process the interruption processing routine of the step S100. The step S101 fetches the number of pulses N for each crank angle of 360 degrees representing the engine rotational speed Ne from the rotational speed counter 101, fetches the intake air amount signal and the intake pressure signal from the analog input port 104, and computes and stores in the RAM 107 the engine rotational speed Ne, the intake air amount Qa and the intake pressure Pm. At step S102, the basic pulse duration Tm is computed to attain the stoichiometric air-fuel ratio (about 15) from the present rotational speed Ne and the intake air amount Qa. Step S103 decides whether or not the feedback condition is established in a manner similar to step S400, and if the feedback condition is not established, the process is passed to the step S104 for computing the final output pulse duration Ti of the injection valve from the equation below.

$$Ti = K_1 \times Tm$$

Then at step S105, since the feedback is not involved, the close signal of the bypass air electromagnetic valve is applied to the electromagnetic valve control section 112. At step S106, the injection number n is set to zero. If the feedback condition is established at step S103, in contrast, the step S103 branches to "Yes," and at step S107, the learning correction amount ΔT (p,r) corresponding to the engine rotational speed Ne and the intake pressure Pm is read from the map as shown in FIG. 5 in RAM 107.

Figures 5, 7:
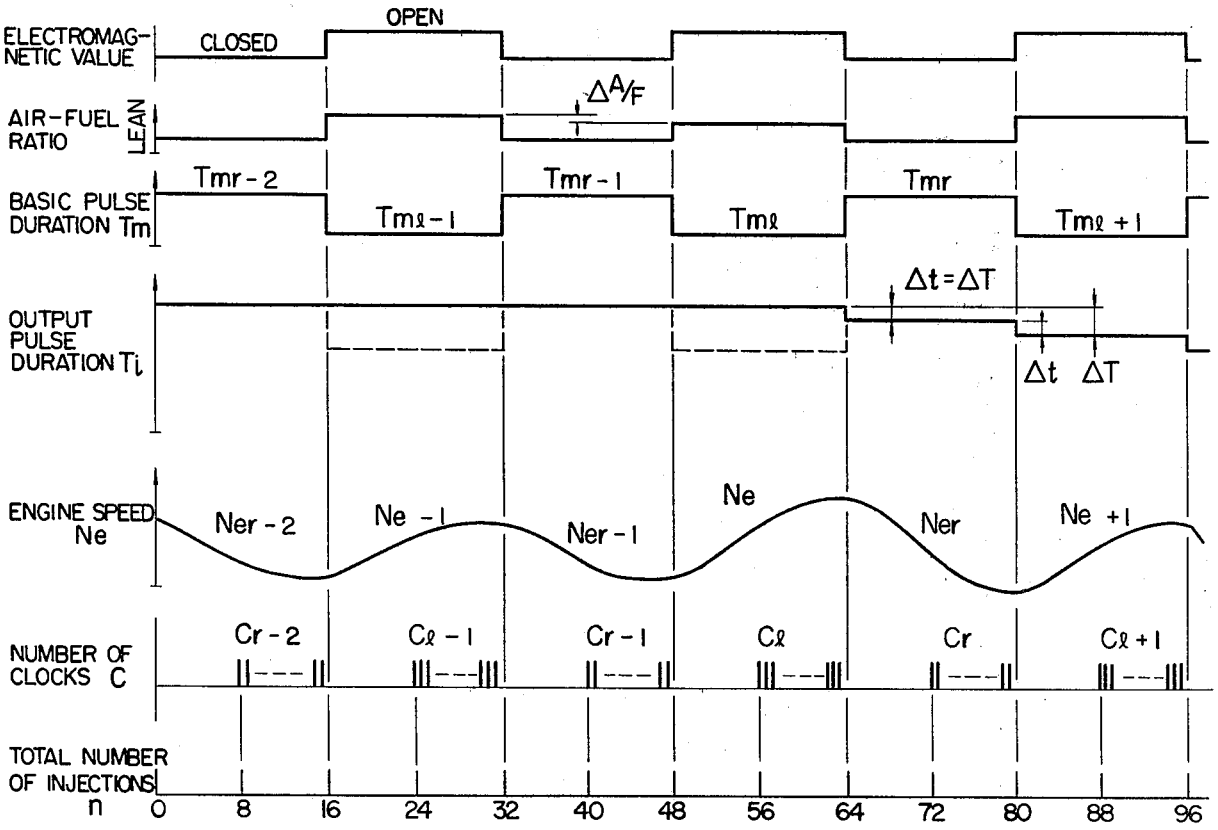
FIG. 5 is a diagram showing the map in the RAM of FIG. 2.
FIG. 7 is a diagram showing the secular variation of the processing operation shown in FIG. 3.

The memory shown in FIG. 5 is made up of a nonvolatile memory in the computer for dividing the rotational speed Ne and the intake pressure Pm at predetermined intervals and stores ΔT (p,r). Referring to FIG. 3, step 108 is for computing the dither correction amount $K_2$ for maintaining constant the fuel flow rate per hour regardless of the operation of the electromagnetic valve in the case where the operation of the bypass air electromagnetic valve causes the amount of air flowing in the air amount sensor 6 to change so that the basic pulse duration Tm is changed thereby to cause an unstable amount of fuel injected.

Let us consider the manner in which the intake air amount Qa is changed by the operation of the electromagnetic valve 12. In the case where the opening of the throttle valve 4 is constant, the intake air amount Qa is determined by the pressures Pb and Pm shown in FIG. 1. When the pressure Pm is below the critical level, the velocity of air passing through the throttle valve 4 is equal to the velocity of sound, and therefore regardless of the operation of the electromagnetic valve 12, the amount of air passing through the air amount sensor 6 is maintained constant, so that the basic pulse duration Tm remains unchanged.

As the pressure Pm approaches Pb, the effect of the electromagnetic valve increases. The change of air amount passing through the air amount sensor 6 due to the opening or closing of the electromagnetic valve is negligible as compared with the change of the bypass air passing through the electromagnetic valve 12. Nevertheless, this slight change of air amount passing through the air amount sensor 6 is important, since without changing the bypass air amount with a fixed fuel flow rate, it is impossible to control the fuel consumption rate in the true sense of the word.

Figure 6:
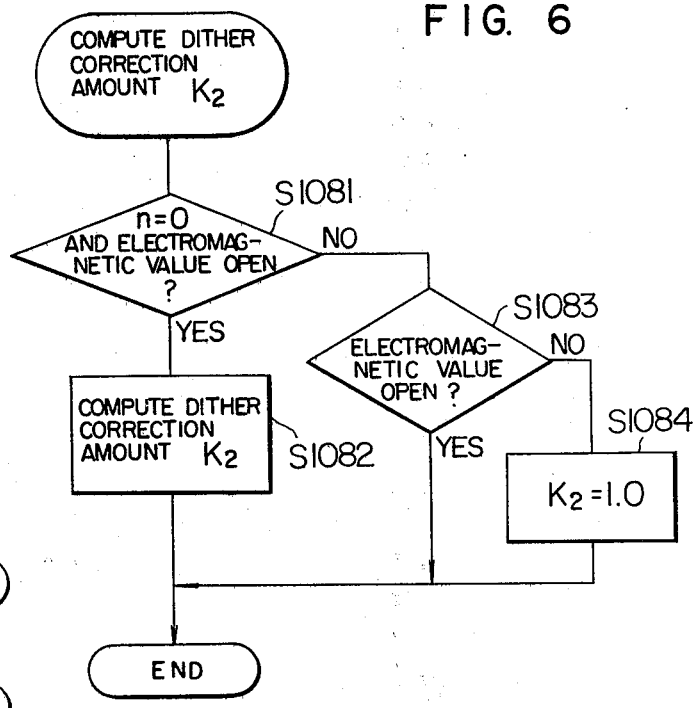
FIG. 6 is a detailed flowchart of the dither correction amount computing step shown in FIG. 3.

FIG. 6 shows a detailed flowchart of the step S108 FIG. 3. Step S1081 decides whether or not n=0, namely, whether or not the electromagnetic valve is in initial stage of switching and is open. If n=0 and the electromagnetic valve is open, the step S1081 branches to "Yes," so that the dither correction amount $K_2$ is determined at step S1082.

The dither correction amount $K_2$ will be explained with reference to the time chart of FIG. 7. If the present total number of injections is 48, the average value of the basic pulse (Tm r−1, Tm l−1) and the average value of rotational speed (Ne r−1, Ne l−1) in the immediately preceding closed state of the electromagnetic valve (32 to 48 in the number of times of injections) and in the second preceding open state thereof (16 to 32 in the number of times of injections) are used to compute the value $K_2$ from the equation below, which is stored in RAM 107.

$$K_2 = \frac{Tm_{r-1} \times Ne_{r-1}}{Tm_{l-1} \times Ne_{l-1}}$$

When n is not zero or the electromagnetic valve 12 is closed at step S1081, the process branches to "No" to step S1083 where if the electromagnetic valve is open, the processing operation of $K_2$ is completed. If the electromagnetic valve is closed, on the other hand, the value $K_2$ is set to 1.0 at step S1084 without dither correction by $K_2$. In this way, when the electromagnetic valve is open, the decreased fuel flow rate is computed from the preceding engine conditions, so that without storing the correction factor $K_2$ for all the engine operating conditions, it is possible to determine an accurate correction factor by a simple computation.

Returning to FIG. 3, the step S109 computes the output pulse duration Ti fed back by the equation below.

$$Ti = K_2 \times Tm + \Delta T(p,r)$$

At step S110, the number of injections n is changed to n+1 for count up, after which the step S111 sets the output pulse duration of the injection valve 14 at the counter 109. The process then proceeds to step S112 for returning to the main routine.

When the number n reaches D at step S401 in FIG. 4 (namely, D=16, or 16 injections in the time chart of FIG. 7), the number of clock pulses determined in the second half of the dither period, namely, the number of clock pulses C shown in FIG. 7 is compared for the four preceding rotational periods including the present period. The number of clock pulses is counted for the second half of the dither period for the reason that the change of the air-fuel ratio due to the bypass air electromagnetic valve 12 has fully affected the rotational speed. Step S402 checks to see whether the electromagnetic valve is presently open or closed, and if it is closed, the process is passed to step S403 where the numbers of clock pulses $C_{l-1}$, $C_{r-1}$, $C_l$ and $C_r$ for the four rotational periods are compared with each other, where $C_r$ is the number of clock pulses for the present rich step, $C_l$ is the number of clock pulses for the immediately preceding lean step (electromagnetic valve open), $C_{r-1}$ is the number of clock pulses for the second preceding rich step (electromagnetic valve closed) and $C_{l-1}$ is the number of clock pulses for the third preceding lean step.

Step S403 decides whether or not the relation $C_{l-1} > C_{r-1} < C_l > C_r$ holds as a result of the comparison mentioned above, and if this relation holds, the process branches to "Yes" to the step S408. This indicates that when the rotational speed increases at a rich step and decreases at a lean step, an increased fuel amount increases the rotational speed, thus improving the fuel consumption rate. Steps S407 and S408 compute the pulse duration learning correction amount $\Delta T(p,r)$ The correction amount $\Delta T(p,r)$ corresponding to the present rotational speed Ne and the intake pressure Pm is read from the corresponding address of the map formed in the nonvolatile memory region in the computing circuit, and $\Delta T$ is added or subtracted, so that the value $\Delta T(p,r)$ after this computation is written to the corresponding address of the memory anew.

In the case where the relation $C_{l-1}>C_{r-1}<C_l>C_r$ does not hold at step S403, the process is passed to step S404. The condition $C_{l-1}<C_{r-1}>C_l<C_r$ of step S404 is established when the engine is run at the air-fuel ratio richer than the air-fuel ratio associated with the best fuel consumption rate. In that case, the process is passed to step S407 where $\Delta t$ is subtracted from the memory correction amount $\Delta T(p,r)$ corresponding to the operating conditions involved and the result is stored. Specifically, the injection amount is reduced by the amount corresponding to $\Delta t$ in pulse duration to approach the optimum fuel amount. If the relation $C_{l-1}>C_{r-1}<C_l>C_r$ or $C_{l-1}<C_{r-1}>C_l<C_r$ does not hold, the learning map correction amount $\Delta T$ is not corrected.

If the step S402 decides that the electromagnetic valve is open or a lean step is involved, the process is passed to step S405, and if the relation $C_{r-1}<C_{l-1}>C_r<C_l$ holds the process proceeds to step S408 for adding $\Delta t$ to the correction amount $\Delta T$ (p,r) and storing the result thereof. If the relation $C_{r-1}<C_{l-1}>C_r<C_l$ does not hold at step S405, the process branches to "No," followed by the step S406 for deciding whether or not the relation $C_{r-1}>C_{l-1<Cr}>C_l$ holds. If this relation holds, the process branches to "Yes" so that $\Delta t$ is substracted from the correction amount $\Delta T(p,r)$ and the result is stored. In the event that this relation does not hold, by contrast, the process branches to "No," in which case the correction amount $\Delta T(p,r)$ is not corrected. Upon completion of the correction of the correction amount $\Delta T(p,r)$ the process is passed to step S409 where the count n of the number of injections is set to zero, followed by step S410 where if the electromagnetic valve is open thus far, a close signal is applied to the electromagnetic valve control section 112, and vice versa. The computation of the learning map correction is now over, followed by the process of step S3.

The aforementioned control operation permits the air-fuel ratio to be controlled to the level associated with the optimum fuel consumption rate by correction of the air-fuel ratio if it is displaced from the level associated with the optimum fuel consumption rate under steady engine operation. Also, since the optimum correction amount $\Delta T(p,r)$ for each operating condition is stored, each operating condition is controlled to optimum state. The flow rate in the bypass air electromagnetic valve 12 is selected in such a manner as to satisfy both the drivability and the ability of detecting the change of the rotational speed, while the fuel correction amount $\Delta t$ is selected to be $\frac{1}{2}$ or less or the change of the air-fuel ratio by the bypass air electromagnetic valve 12.

In the aforementioned embodiment, the dither correction amount $K_2$ is determined from the ratio of fuel flow rate between the immediately preceding dither state and the second preceding dither state. Instead of this method, the value $K_2$ based on the engine rotational speed and the intake pressure may be stored in advance in ROM.

Further, the ratio of fuel flow rate $$K_2 = \frac{Tm_{r-1} \times Ne_{r-1}}{Tm_{l-1} \times Ne_{l-1}}$$

may be replaced by $$K_2 = \frac{Tm_{r-1}}{Tm_{l-1}}$$

involving only the pulse durations.

I claim:

1. A method of controlling air-fuel ratios for an internal combustion engine comprising the steps of:

(i) systematically varying the air-fuel ratio applied to said engine by supplying or not supplying bypass air through a bypass air supply path;

(ii) detecting signals representing the operating conditions of the engine at a plurality of operating points when the engine is operated at different air-fuel ratios produced by said varying step;

(iii) comparing the signals detected at said operating points and deciding whether the air-fuel ratios applied to said engine are rich or lean as compared with the air-fuel ratio associated with the optimum fuel consumption rate;

(iv) discriminating whether the bypass air is supplied or not supplied currently;

(v) changing the value of a correction amount on the basis of the result of the above discriminating step; and (vi) changing a basic fuel injection amount by said correction amount to produce a modified fuel injection amount, said correction amount being chosen to maintain said modified fuel injection amount nearly constant despite changes in the air-fuel ratio caused by said varying step; and (vii) correcting said modified fuel injection amount on the basis of said comparing step to optimize the air-fuel ratio for the operating conditions of the engine.

2. A method according to claim 1, wherein the correction amount for producing a modified fuel injection amount is determined from the ratio between basic fuel injection amounts for the preceding variations of air-fuel ratios by said varying step.

3. A method according to claim 1, wherein said signals in the detecting step represent the rotational speed of the engine.

4. A method according to claim 1, wherein said signals in the detecting step represent the torque of the internal combustion engine.

5. An apparatus for controlling the air-fuel ratio applied to an internal combustion engine comprising:

a rotational speed sensor means for detecting the engine rotation speed r;

main air supply means for supplying intake air to said engine;

air flow sensor means for detecting the amount of air p passing through said main air pipe;

bypass air supply means for supplying bypass air to said engine;

air valve means for controlling the supply of bypass air flowing through said bypass air supply means;

fuel injector means for injecting controllable amounts of fuel into said engine; and computer means for:

computing a basic fuel injection amount $T_m$ in response to outputs of said rotational speed and air flow sensor means;

operating said air valve means to alternate said air-fuel ratio between rich and lean by controlling said air valve means to alternate between the supply and non-supply of bypass air;

discriminating between supply or nonsupply of the bypass air, and changing the value of a first correction amount $K_2$ on the basis of the result of the discrimination;

changing said basic fuel injection amount by said first correction amount to produce a modified fuel injection amount which remains nearly constant despite change in the air-fuel ratio caused by said air valve means;

detecting the operating condition of said engine at a plurality of predetermined operating points, said operating points including supply and non-supply of bypass air by said air valve means, to obtain a second correction amount T;

correcting said modified injection amount by said second correction amount to obtain an optimum injection amount $T_i$; and controlling the amount of fuel injected by said fuel injector means with said optimum injection amount.

6. An apparatus according to claim 5, wherein said first correction amount is computed from the average value of said basic fuel injection amount and the average value of engine rotational speed in a preceding predetermined period during which bypass air is not supplied by said air valve means.

7. An apparatus according to claim 5, wherein said optimum fuel injection amount Ti is computed by the following equation:

$$Ti = K_2 \times Tm + \Delta T(p,r).$$

8. An apparatus as in claim 5 wherein said computer means further comprises non-volatile memory means for storing said first and second correction amounts and said optimum injection amount.

* * * * *